US008871160B2

(12) United States Patent
Seo et al.

(10) Patent No.: US 8,871,160 B2
(45) Date of Patent: Oct. 28, 2014

(54) BIOMATERIAL DETECTING DEVICE

(75) Inventors: Sung-Min Seo, Seoul (KR); Jae-Hyung Park, Daejeon (KR); Oleksandrov Sergiy, Daejeon (KR); Joong Hwan Lee, Daejeon (KR); Mun-Cheol Paek, Daejeon (KR); Su-Jin Ku, Daejeon (KR)

(73) Assignee: K-MAC, Daejeon (KR)

( * ) Notice: Subject to any disclaimer, the term of this patent is extended or adjusted under 35 U.S.C. 154(b) by 0 days.

(21) Appl. No.: 13/554,504

(22) Filed: Jul. 20, 2012

(65) Prior Publication Data

US 2013/0225453 A1 Aug. 29, 2013

(30) Foreign Application Priority Data

Feb. 29, 2012 (KR) ..... 10-2012-0021278

(51) Int. Cl.
*C40B 60/12* (2006.01)
*B01L 3/00* (2006.01)

(52) U.S. Cl.
CPC ..... *B01L 3/50853* (2013.01)
USPC ..... 422/558; 422/400; 422/547; 422/548; 422/549; 422/550; 422/568; 422/569; 422/570; 422/939; 422/944; 422/913; 215/247; 220/259.1; 222/568; 222/569; 222/570; 141/98; 141/319; 206/430

(58) Field of Classification Search
CPC ..... B01L 3/50853; B01L 3/50825
USPC ..... 422/400, 547–550, 568–570, 558, 939, 422/940, 944, 913; 215/247; 220/259.1; 222/568–570; 141/98, 319; 206/430
See application file for complete search history.

(56) References Cited

U.S. PATENT DOCUMENTS

| | | | | |
|---|---|---|---|---|
| 4,624,929 | A * | 11/1986 | Ullman | 436/179 |
| 5,738,670 | A * | 4/1998 | Grippi | 604/403 |
| 6,149,866 | A * | 11/2000 | Luotola et al. | 422/401 |
| 2001/0008614 | A1 * | 7/2001 | Aronowitz | 422/101 |
| 2005/0238535 | A1 * | 10/2005 | Knezevic et al. | 422/61 |
| 2006/0216196 | A1 * | 9/2006 | Satoh et al. | 422/61 |
| 2007/0166198 | A1 * | 7/2007 | Sangha et al. | 422/99 |
| 2008/0188009 | A1 * | 8/2008 | Ford et al. | 436/518 |
| 2008/0274512 | A1 * | 11/2008 | Squirrell et al. | 435/91.2 |
| 2009/0117603 | A1 * | 5/2009 | Franciskovich et al. | 435/19 |

FOREIGN PATENT DOCUMENTS

| | | | |
|---|---|---|---|
| JP | 08506893 | A | 7/1996 |
| JP | 2003107083 | A | 4/2003 |
| JP | 2006-149361 | A | 6/2006 |
| KR | 10-2003-0096877 | A | 12/2003 |
| KR | 10-2006-0060069 | A | 6/2006 |
| WO | 2011-162285 | A1 | 12/2011 |

OTHER PUBLICATIONS

Japanese Office Action dated Dec. 26, 2013.

* cited by examiner

*Primary Examiner* — Shogo Sasaki
(74) *Attorney, Agent, or Firm* — Lowe Hauptman & Ham, LLP

(57) ABSTRACT

Provided is a biomaterial detecting device for confirming or detecting a biomaterial reaction, and more particularly to a biomaterial detecting device, which is formed in a stick type to thereby be immersed in a tube containing a biomaterial solution to be tested; has an upper portion with a cap structure to thereby induce reaction with a biomaterial, and thus facilitate confirmation and detection of the biomaterial; and is formed in a cap structure to thereby prevent evaporation of a sample and infiltration of an external material at the time of a biomaterial reaction in the tube, and thus improve reliability in analysis.

5 Claims, 9 Drawing Sheets

BIOMATERIAL DETECTING DEVICE

CROSS-REFERENCE TO RELATED APPLICATIONS

This application claims priority under 35 U.S.C. §119 to Korean Patent Application No. 10-2012-0021278, filed on Feb. 29, 2012, in the Korean Intellectual Property Office, the disclosure of which is incorporated herein by reference in its entirety.

TECHNICAL FIELD

The following disclosure relates to a biomaterial detecting device for confirming or detecting a biomaterial reaction, and more particularly to a biomaterial detecting device, capable of facilitating confirmation and detection of a biomaterial by being coupled with a tube containing a biomaterial solution to be tested such that a detector is immersed in the biomaterial solution, to thereby induce a reaction between the biomaterial and the detector, and capable of improving reliability in analysis by having a cap structure to thereby prevent evaporation of a sample and infiltration of an external material at the time of a biomaterial reaction in the tube.

BACKGROUND

Generally, a DNA microarray (DNA chip) technology is used in order to confirm or detect genes, infection sources, germs, mutants, genotyping, gene expression, or the like.

This technology is realized by immobilizing a nucleic acid probe, an antibody, or the like, on various solid surfaces such as a glass substrate, a metal substrate, a bead, a plastic, and the like, and has been employed for performing medical diagnosis in hospitals or clinics since many different targets can be simultaneously analyzed.

Meanwhile, convenience and reliability are very important factors in view of clinical diagnosis. In cases of the existing DNA microarrays and protein chips, a chamber called a frame seal is formed on a flat slide glass, and a solution is put thereinto, so that a bioreaction is allowed to proceed. However, after the reaction, the seal needs to be torn and washed. Therefore, this work may require a large amount of labor and skilled workers and moreover be cumbersome.

In addition, a multi-well plate where a plurality of wells (containing spaces) is formed in a plate shape such that samples are contained therein for reaction with biomaterials is sometimes used. In addition, a small amount of sample from the solution containing biomaterials, which is contained in a reaction container such as a tube or the like, is injected into the well from the solution by using a pipette or the like, and then the biomaterial reaction is allowed to occur by using a DNA chip.

However, these methods may not be widely employed in hospitals or clinics, since it is inconvenient to transfer some samples from the reaction container and inject them into the wells or frame seals, and it is difficult to automate a series of procedures such as injection of samples, reaction of biomaterials, detection of results, and analysis of results.

Moreover, in the case of gene amplification reaction, the samples are evaporated at the time of heating for reaction of the samples, which may have a large effect on the results of the biomaterial reaction, and thus, reliability in analysis may be deteriorated.

In this regard, Korean Laid-Open Publication No. 10-2006-0060069 discloses an apparatus for minimizing evaporation or condensation of samples in tubes of a multi-well plate, installed in a heat circulator for PCR.

RELATED ART DOCUMENTS

Patent Document (Patent Document 1) KR 10-2006-0060069 A (May 6, 2006.)

SUMMARY

An embodiment of the present invention is directed to providing a biomaterial detecting device, capable of obviating inconveniences arising from injecting a sample into the existing well or frame seal, and automating a series of procedures such as injection of the sample, reaction with a biomaterial, detection of results, and analysis of results.

Another embodiment of the present invention is directed to providing a biomaterial detecting device capable of, in the case of a gene amplification reaction, preventing the sample from being evaporated at the time of heating for reaction of the sample, to thereby improve reliability in analysis of a biomaterial reaction.

In one general aspect, there is provided a biomaterial detecting device, including: a head 100; a tube coupler 200 protruded downwardly from the head 100; a rod 300 extended downwardly from the tube coupler 200; and a detector 400 formed at a lower side of the rod 300.

The rod 300 may be detachable from the tube coupler 200.

The tube coupler 200 may have protrusions 210 formed on an outer circumferential surface thereof.

The head 100 may have an adaptor 600 formed thereon.

Here, in the adaptor 600, an upper portion may have a larger diameter than a lower portion.

The detector 400 may include materials coated on a lower surface thereof, the materials being selected from the group consisting of protein, nucleic acid, peptide nucleic acid (PNA), aptamer, and antibody.

The detector 400 may include materials arrayed on a lower surface thereof, the materials being selected from the group consisting of protein, nucleic acid, peptide nucleic acid (PNA), aptamer, and antibody.

The biomaterial detecting device may further include a direction indicator 500 for confirming a direction.

[Detailed Description of Main Elements]

Figure 1:
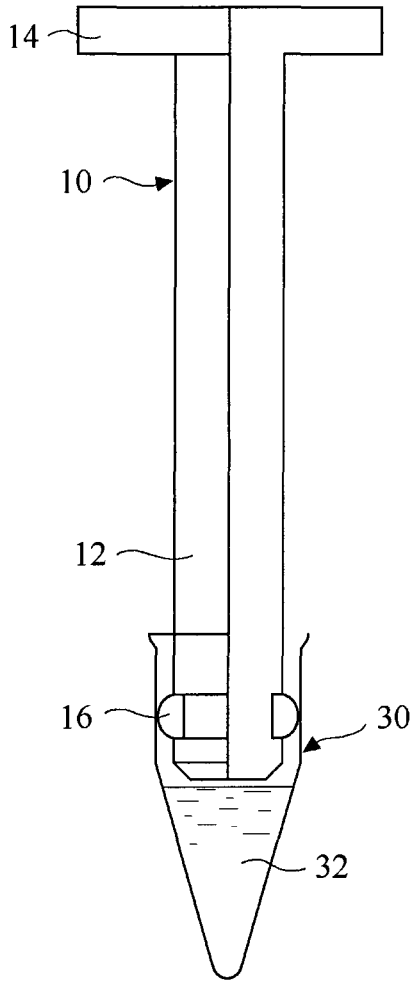
FIG. 1 Prior Art
FIG. 1 is a schematic view showing an apparatus for minimizing evaporation or condensation of a sample in a tube of a multi-well plate installed in a heat circulator for PCR of the related art.

1000: biomaterial detecting device (of the present invention)
100: head
200: tube coupler 210: protrusion
300: rod
400: detector
500: direction indicator
600: adaptor
700: tube (reaction container)
800: sample

DETAILED DESCRIPTION OF EMBODIMENTS

Hereinafter, the present invention will be described in detail with reference to the accompanying drawings.

Figure 2:
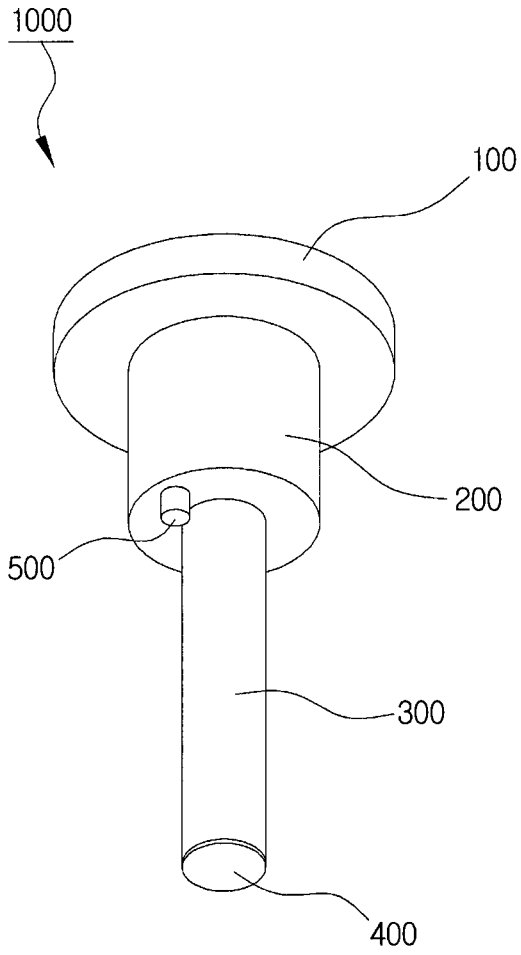
FIGS. 2 and 3 are a perspective view and a front view showing a first embodiment of a biomaterial detecting device of the present invention.
Figure 3:
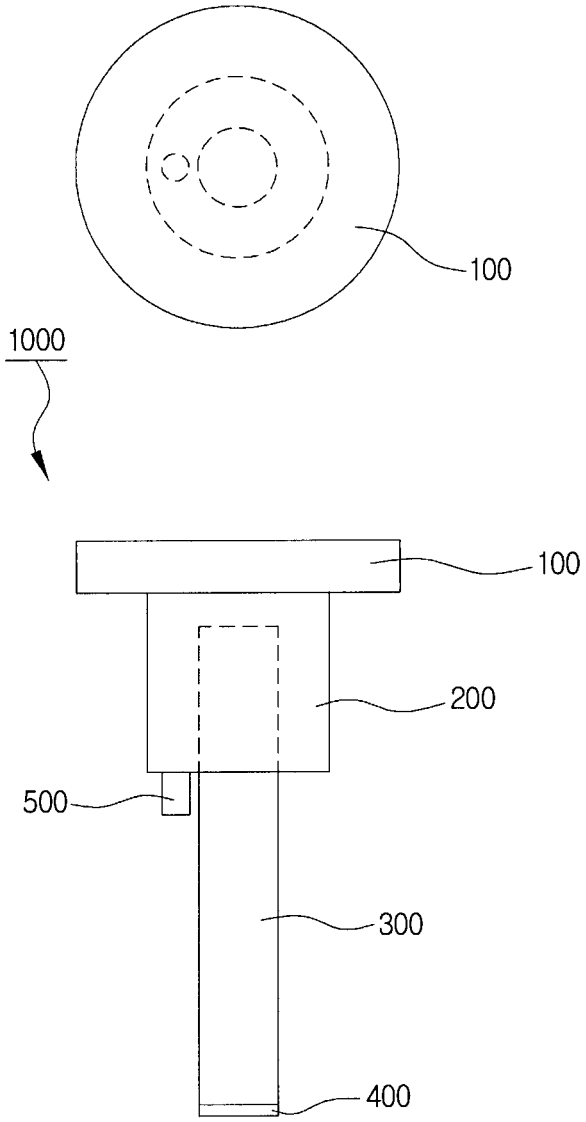

FIGS. 2 and 3 are a perspective view and a front view showing a first embodiment of a biomaterial detecting device of the present invention.

As shown in the drawings, a biomaterial detecting device 1000 of the present invention may include: a head 100; a tube coupler 200 protruded downwardly from the head 100; a rod 300 extended downwardly from the tube coupler 200; and a detector 400 formed at a lower side of the rod 300.

First, the head 100 may be formed in a flat plate shape, a block shape, or the like. When the biomaterial detecting device 1000 is manually transferred by a hand of the user or coupled with or decoupled from the tube (reaction container) containing the sample, the head may receive a force applied thereto or may be combined with an automated device to be movable.

The tube coupler 200 is protruded downwardly from the head 100, and the tube may be outwardly inserted into and coupled with the tube coupler 200. Herein, a groove is formed in an outer circumferential surface of the tube coupler 200 along a circumferential direction thereof, and an elastic sealing member such as an O-ring is combined with the groove, so that an inside of the tube can be sealed when the tube is inserted into and coupled with the tube coupler 200.

The rod 300 may be extended downwardly from the tube coupler 200, and may be lengthily formed in a stick shape along a lower direction thereof. Here, the rod 300 preferably has a smaller diameter than the tube coupler 200. Since the rod 300 is contacted with the sample such as a biomaterial solution, the rod 300 is preferably formed of glass having no reactivity with the sample.

In addition, the rod 300 may be detachable from the tube coupler 200. That is, a hole is formed in a lower portion of the tube coupler 200, and the rod 300 is inserted into the hole and coupled with the tube coupler 200. Thus, the rod 300 may be replaced, as necessary.

In addition, the detector 400 is formed at the lower side of the rod 300. The detector 400 is immersed in the sample, to thereby react with the sample, and thus, can detect a target material.

Here, materials selected from the group consisting of protein, nucleic acid, peptide nucleic acid (PNA), aptamer, and antibody may be coated on a lower surface of the detector 400. That is, target gene probes may be coated and immobilized on the lower surface of the detector 400, to thereby detect a biomaterial.

In addition, materials selected from the group consisting of protein, nucleic acid, peptide nucleic acid (PNA), aptamer, and antibody may be arrayed (arranged) on the lower surface of the detector 400. That is, the target gene probes may be arrayed so as to detect the biomaterial, such that they are immobilized to have particular directivity.

Figure 4:
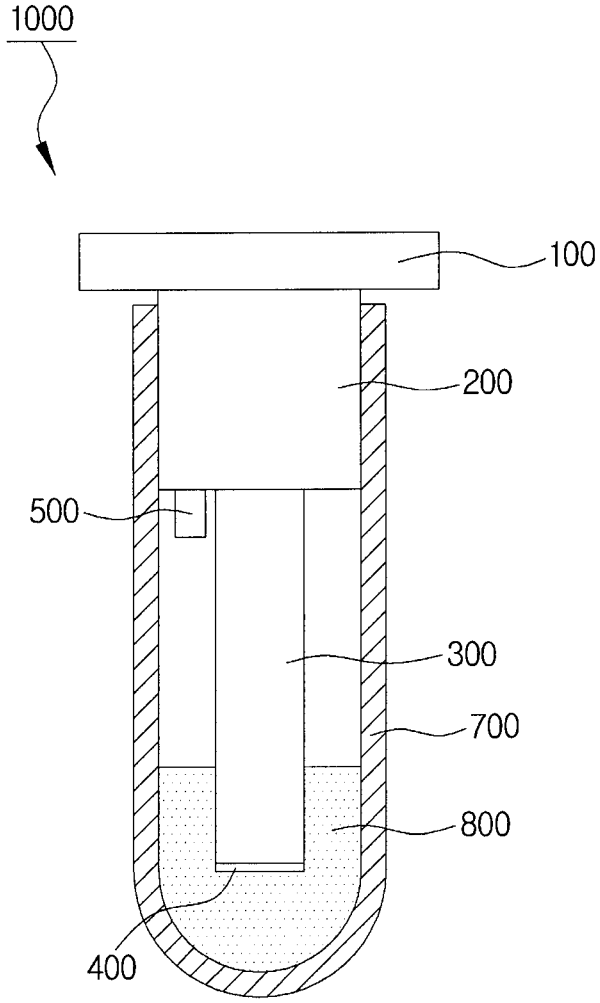
FIG. 4 is a cross sectional view showing a reaction container containing a sample, which is coupled with the structure of FIG. 3.

As such, the biomaterial detecting device 1000 of the present invention includes the head 100, the tube coupler 200, the rod 300, and the detector 400, and the tube coupler 200 may be inserted into and coupled with the tube 700 containing the sample, as shown in FIG. 4. Here, the detector 400 formed at the lower side of the rod 300 is immersed in the sample 800 in the tube 700. Hence, gene application and hybridization may be allowed to proceed in the tube 700, and simultaneously, the amplified gene may react with the target gene probes of the detector 400 during the hybridization procedure, to thereby induce conjugation and reaction with the target gene probes.

That is, the real-time polymerase chain reaction (PCR, gene amplification) is allowed to proceed in the tube 700, and a fluorescent signal generated in the tube 700 is acquired in real-time by using a monitoring apparatus. After that, the hybridization is allowed to proceed, and the rod 300 and the detector 400 are separated from the tube 700, and then washed. Then a fluorescent signal reacting with the probe is obtained by using an exclusive fluorescent detector, and then the DNA chip (detector) analysis may be carried out. Therefore, the real-time PCR and the DNA chip analysis can be integratedly carried out in one tube.

In addition, the biomaterial detecting device is coupled with the reaction container (tube) containing the sample in a cap type while the detector formed at the end portion of the rod is immersed in the sample therein, so that the biomaterial reaction can be easily detected, thereby obviating the cumbersomeness of transferring the amplified gene, preventing contamination due to external factors generable during this procedure, and automating a series of procedures such as injection of the sample, reaction of the biomaterial, and detection of results.

In addition, in the case of gene amplification reaction, the sample can be prevented from being evaporated at the time of heating for reaction of the sample, thereby improving reliability in analysis of the biomaterial reaction.

Hereinafter, the present invention will be described in detail.

First, protrusions 210 may be formed on an outer circumferential surface of the tube coupler 200.

Figure 5:
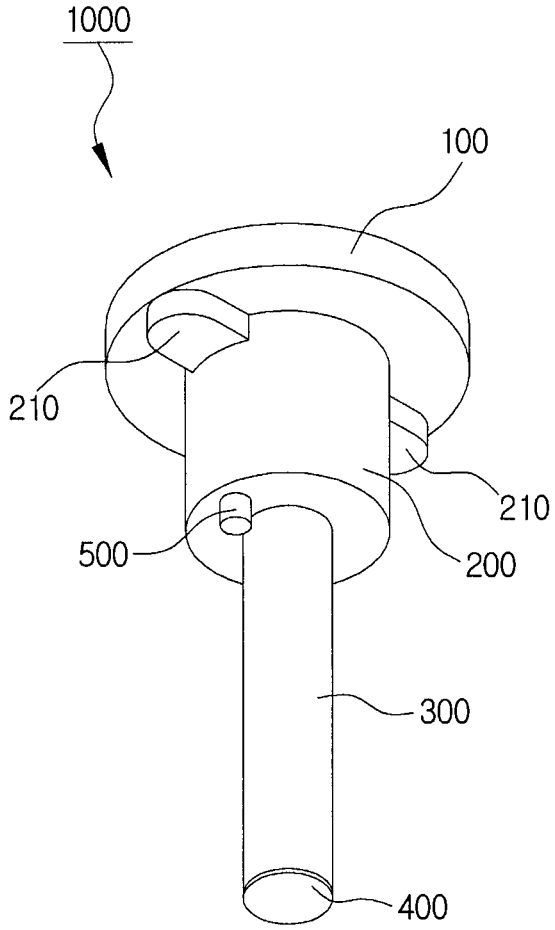
FIGS. 5 and 6 are a perspective view and a front view showing a second embodiment of a biomaterial detecting device of the present invention.
Figure 6:
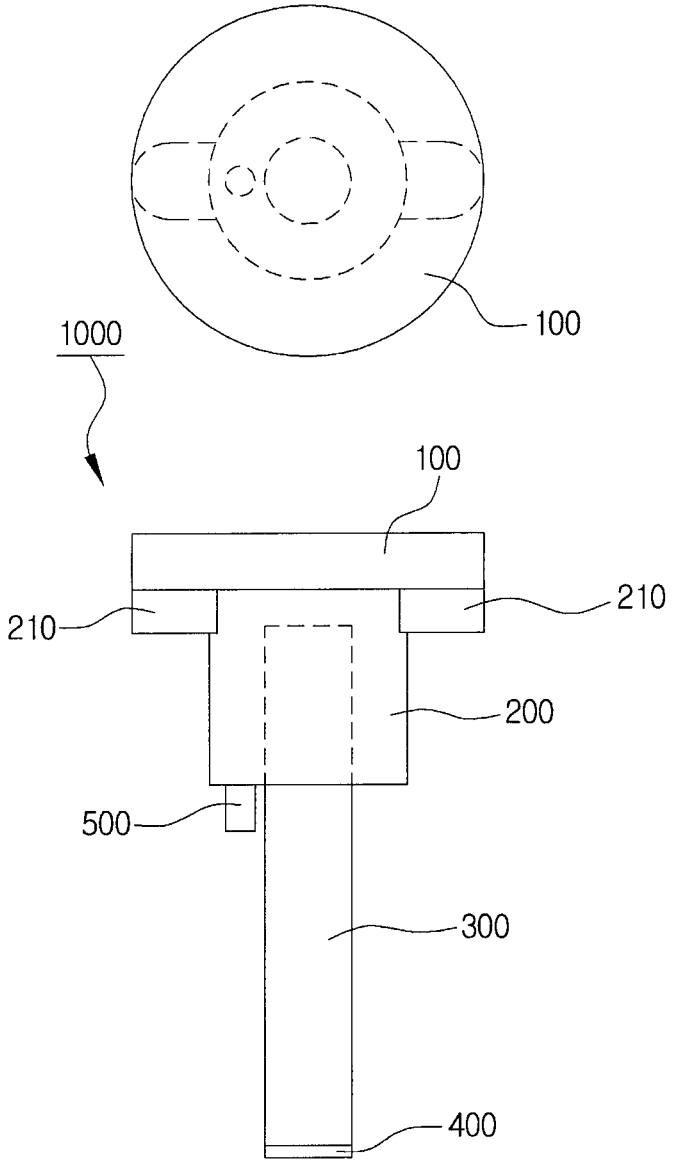
Figure 7:
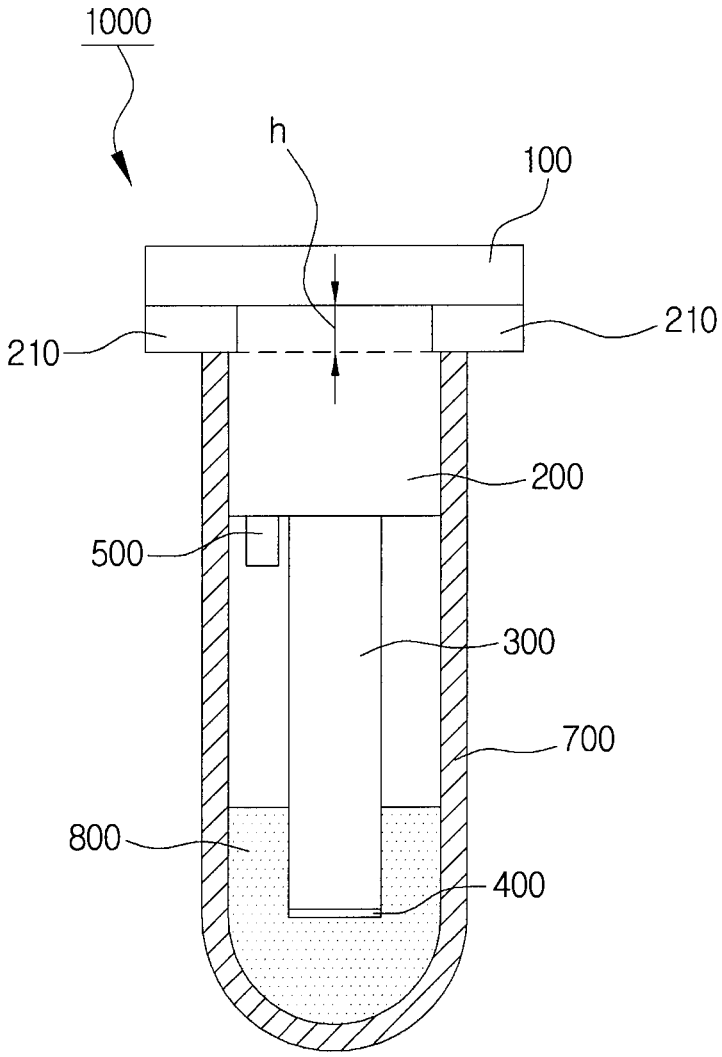
FIG. 7 is a cross sectional view showing a reaction container containing a sample, which is coupled with the structure of FIG. 6.

As shown in FIGS. 5 and 6, the protrusions 210 may be formed at both sides of the tube coupler 200 below the head 100. The reason is that, when the tube 700 is outwardly inserted into the tube coupler 200, the upper side of the tube 700 is caught by the protrusions 20 to thereby not be further inserted into the tube coupler 200, so that the head 100 is spaced apart from the tube 700 by a predetermined height (h) to thereby form a space, as shown in FIG. 7. That is, the space is generated between the tube 700 and the head 100 by the protrusions 210, and thus, this space allows the tube 700 and the head 100 to be easily separated from each other while they are held with both hands.

Here, the protrusions 210 may be formed in various shapes, at various positions, and in various numbers. The protrusions 210 may be formed at both sides of the tube coupler 200 as described above, or may be protruded from only one side of the tube coupler 200. Also, the protrusions 210 may be spaced apart from the lower surface of the head 100 at a predetermined distance.

Figure 8:
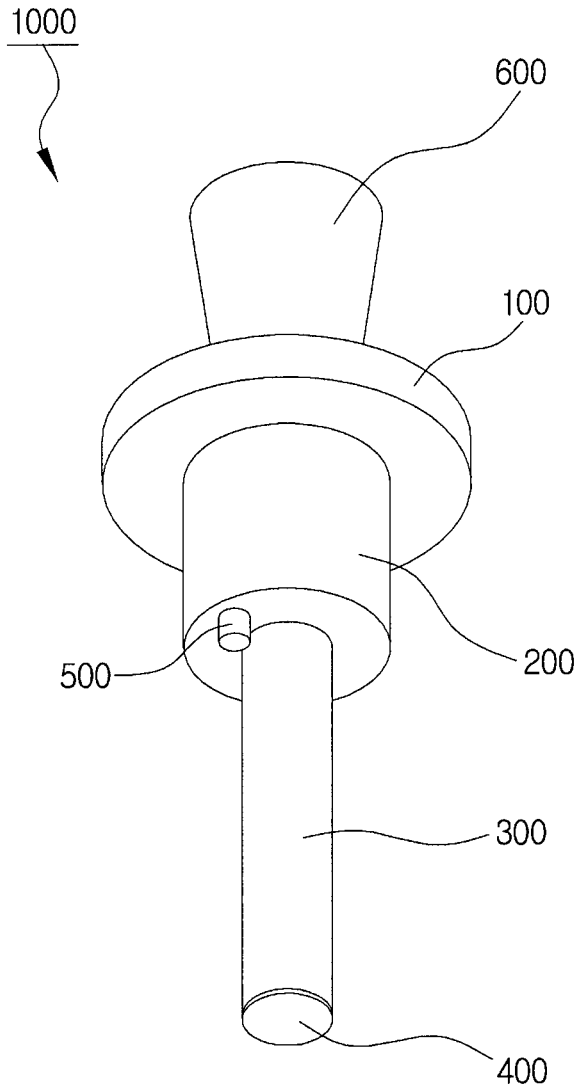
FIGS. 8 and 9 are a perspective view and a front view showing a third embodiment of a biomaterial detecting device of the present invention.
Figure 9:
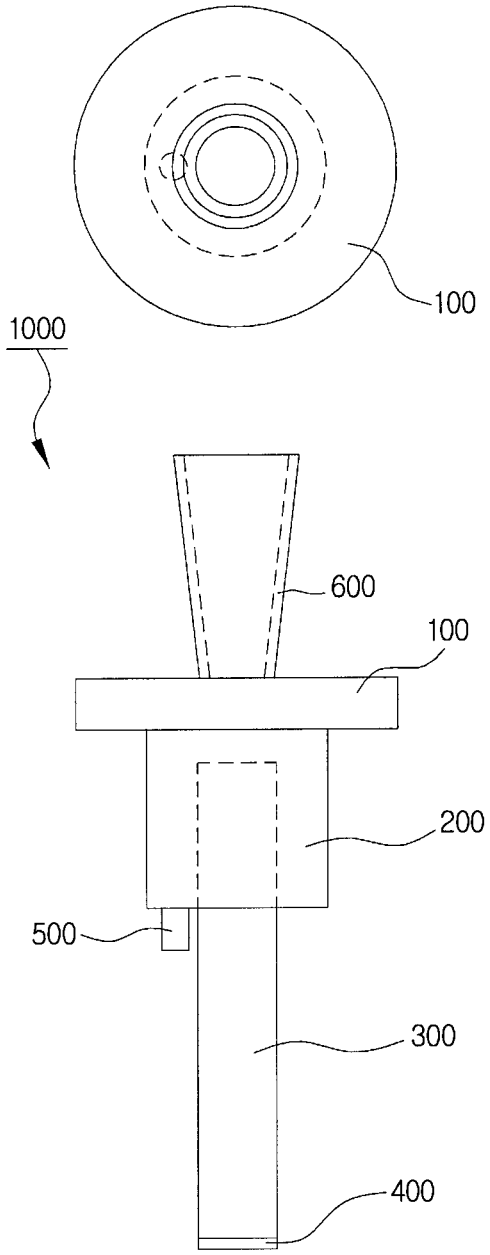

In addition, an adaptor 600 may be extended from an upper side of the head 100, as shown in FIGS. 8 and 9.

Due to the adaptor 600, the biomaterial detecting device 1000 of the present invention can be easily moved and detached from the tube 700 by using an automating equipment. In addition, by combining the adaptor 600 with the automation equipment, the biomaterial detecting device 100 of the present invention can be easily coupled with the tube 700, decoupled therefrom after reaction, washed after being transferred, and transferred to a monitoring device for detection, and used for other procedures.

In addition, as for the adaptor 600, an upper portion thereof may have a larger diameter than a lower portion thereof. Therefore, in the case where the adaptor 600 is inserted into and combined with a mounting portion of the automation equipment, since the diameter of the upper side of the adaptor 600 is large, separation of the adaptor 600 can be prevented while the biomaterial detecting device 1000 is decoupled from the tube 700. Here, the adaptor 600 may be inclined outwardly and upwardly, or an upper portion of the adaptor 600 may have a large diameter to thereby form a step protrusion. In addition, an inside of the adaptor 600 may be hollow, such that, the mounting portion of the automation equipment is inserted into and coupled with the hollowed portion of the adaptor 600.

In addition, the biomaterial detecting device 1000 may have a direction indicator 500 for confirming a direction. Since the target gene probes may be arrayed and immobilized to have a particular directivity such that the materials are arrayed (arranged) on the lower surface of the detector 400 to thereby detect the biomaterial, the materials being selected from protein, nucleic acid, peptide nucleic acid (PNA), aptamer, and antibody, the direction indicator 500 may be formed to confirm a direction of the biomaterial detecting device 1000.

That is, the direction indicator 500 may be formed in various types such that the direction of the biomaterial detecting device 1000 can be confirmed. The direction indicator 500 may be formed on one side of the lower surface of the tube coupler 200 such that it is protruded to a space where the coupling with the tube 700 is not interfered. The direction indicator 500 may be formed on the outer circumferential surface of the head 100, the tube coupler 200, or the rod 300 in an intaglio type, or in a type where particular indication is printed.

As such, the biomaterial detecting device of the present invention may be variously applied in various experiment fields below due to the above advantages.

(1) Gene amplification+DNA chip analysis: A plurality of target gene probes are arrayed and immobilized on a bottom of the rod, and a reagent for gene amplification is inputted into the tube. Then, when the biomaterial detecting device is coupled with the tube, the rod is partially immersed in the reagent. Here, as gene amplification and hybridization proceed in the tube, the amplified gene reacts with and combined with the target gene probes (the detector) immobilized underneath the rod during the hybridization procedure. After the reaction is finished, the cap is opened and washing is carried out, and then a fluorescent signal may be measured by using an exclusive fluorescent detector.

(2) Real-time PCR+DNA chip analysis: A plurality of target gene probes are arrayed and immobilized on a bottom of the rod, and the real-time PCR is carried out. A fluorescent signal generated in the tube during the gene amplification procedure is obtained in real-time by using a camera. Then, after hybridization proceeds, a cap is opened and the glass rod attached to the cap is washed. A fluorescent signal reacting with the probes is obtained by using an exclusive fluorescent detector, and then DNA chip analysis is carried out. Therefore, the real-time PCR and DNA chip analysis can be integratedly carried out in one tube.

(3) ELISA analysis: A lower surface of the rod is coated with antibody, followed by washing; a residual portion is filled with a blocking reagent, followed by washing; a glass bar of the cap is immersed in the tube containing a sample to be tested to thereby induce an antibody-antigen reaction, followed by washing; in order to confirm the presence or absence of the antibody-antigen reaction, the glass rod of the cap is again immersed in the tube containing a secondary antibody for signal confirmation, to thereby induce a reaction, followed by washing; and a fluorescent or a substrate is injected to obtain a signal of color formation or light emission.

(4) RIA analysis: Reactivity may be confirmed by carrying out the same procedure as Item 3) to obtain a radioisotope signal as a final signal.

(5) Protein array (Protein chip): A plurality of target antibodies are arrayed and immobilized on a lower surface of the rod, and then the same procedure as Item 3), from the process of blocking the residual portion, is carried out to obtain a signal.

As set forth above, according to the biomaterial detecting device of the present invention, the biomaterial detecting device is coupled with the reaction container (tube) containing a sample in a cap form while the detector formed at an end of the rod is immersed in the sample therein, thereby facilitating detection of the biomaterial reaction and automating a series of procedures such as injection of the sample, reaction with the biomaterial, detection of results, and analysis of results.

Further, the biomaterial detecting device of the present invention, in the case of gene amplification reaction, can prevent the sample from being evaporated at the time of heating for reaction of the sample, thereby improving reliability in analysis of the biomaterial reaction.

The present invention is not limited to the above-mentioned embodiments and an applied range thereof may be various. Also, various modifications of the present invention may be made by those skilled in the art without departing from the gist of the present invention.

What is claimed is:

1. A biomaterial detecting device, comprising:

a tube;

a head having a bottom surface and a first diameter;

a tube coupler, having a second diameter, protruded downwardly from the bottom surface of the head, wherein the tube coupler is configured to be sealingly coupled with the tube in a manner to be inserted into an inside of the tube, and wherein the first diameter of the head is larger than the second diameter of the tube coupler;

a rod extended downwardly from a bottom surface of the tube coupler, configured to be placed inside the tube without contacting the tube, and having a lower surface;

a detector formed at the lower surface of the rod and configured to detect a fluorescent or color formation signal generated by a reaction of a target biomaterial in a sample inside the tube; and a first protrusion and a second protrusion formed on a first portion and a second portion of an outer circumferential surface of the tube coupler, respectively, and also protruded from the bottom surface of the head, wherein the first and second portions are circumferentially spaced from each other along the outer circumferential surface of the tube coupler, portions of the outer circumferential surface of the tube coupler other than the first and second portions are larger than the first and second portions, and the protrusions are formed so that the bottom surface of the head is prevented from contacting the tube by the thickness of the protrusions.

2. The biomaterial detecting device of claim 1, wherein the rod is detachable from the tube coupler.

3. The biomaterial detecting device of claim 1, further comprising: a conically shaped adaptor, wherein an upper portion of the adapter has a larger diameter than a lower portion of the adapter, and wherein the adaptor is formed on a top surface of the head.

4. The biomaterial detecting device of claim 1, wherein the detector includes a material coated on the lower surface thereof, the material being selected from the group consisting of protein, nucleic acid, peptide nucleic acid (PNA), aptamer, and antibody.

5. The biomaterial detecting device of claim 1, wherein the detector includes a material arrayed on the lower surface thereof, the material being selected from the group consisting of protein, nucleic acid, peptide nucleic acid (PNA), aptamer, and antibody; and the biomaterial detecting device further comprises a direction indicator for confirming an alignment of the arrayed material.

* * * * *